US012790077B2

(12) United States Patent
Hare et al.

(10) Patent No.: US 12,790,077 B2
(45) Date of Patent: Nov. 10, 2026

(54) DISPENSING AN ORAL CARE COMPOSITION WITH IMPROVED FLAVOR DISPLAY

(71) Applicant: The Procter & Gamble Company, Cincinnati, OH (US)

(72) Inventors: Tiffany Celeste Hare, West Chester, OH (US); Phillip Asa Drake, Mason, OH (US); Qingxin Lei, Liberty Township, OH (US); Emily Suzanne Allen, Hamilton, OH (US); Steven Hamilton Hoke, II, West Chester, OH (US); Jeremy Clay Christman, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 133 days.

(21) Appl. No.: 18/816,482

(22) Filed: Aug. 27, 2024

(65) Prior Publication Data

US 2025/0090291 A1 Mar. 20, 2025

Related U.S. Application Data

(60) Provisional application No. 63/651,064, filed on May 23, 2024, provisional application No. 63/582,606, (Continued)

(51) Int. Cl.
*B65D 35/38* (2006.01)
*A45D 40/26* (2006.01)
(Continued)

(52) U.S. Cl.
CPC ..... *B65D 35/38* (2013.01); *A45D 40/26* (2013.01); *B65D 47/0804* (2013.01); (Continued)

(58) Field of Classification Search
CPC .. B65D 83/771; B65D 47/0804; B65D 35/38; B65D 2547/066; B65D 47/08; B65D 2547/06; B65D 2547/063; A45D 40/26
(Continued)

(56) References Cited

U.S. PATENT DOCUMENTS 2,103,111 A 12/1937 Ekdahl
2,441,649 A 5/1948 Sprague
(Continued)

FOREIGN PATENT DOCUMENTS

CH 478035 A 9/1969
DE 102004009424 A1 9/2005

OTHER PUBLICATIONS

All Office Actions: U.S. Appl. No. 18/816,452, filed Aug. 27, 2024.
(Continued)

*Primary Examiner* — David J Walczak
(74) *Attorney, Agent, or Firm* — John G. Powell; Elizabeth A. Conklin

(57) ABSTRACT

A method for dispensing an oral care composition includes dispensing the oral care composition through a nozzle to form a dispensed composition. The nozzle includes an orifice having a central axis and an orifice diameter, and fins partially occluding the orifice, where each of the fins has an upper surface and a lower surface. The dispensed composition has an increased flavor display compared to a control dispensed composition made by dispensing the oral care composition through a control nozzle comprising an unobstructed, circular orifice having the orifice diameter.

19 Claims, 3 Drawing Sheets

Related U.S. Application Data filed on Sep. 14, 2023, provisional application No. 63/582,609, filed on Sep. 14, 2023.

(51) Int. Cl.
*B65D 47/08* (2006.01)
*B65D 83/00* (2006.01)

(52) U.S. Cl.
CPC ..... *B65D 83/771* (2025.01); *B65D 47/08* (2013.01); *B65D 2547/063* (2013.01); *B65D 2547/066* (2013.01)

(58) Field of Classification Search
USPC ..... 222/92, 566, 567, 572, 573
See application file for complete search history.

(56) References Cited

U.S. PATENT DOCUMENTS

| | | | | |
|---|---|---|---|---|
| 2,743,852 | A | 5/1956 | Alberdi, Jr. | |
| 3,123,259 | A | 3/1964 | Musel et al. | |
| 3,980,211 | A | 9/1976 | Owens | |
| 4,580,701 | A * | 4/1986 | Tamaki | B65D 47/2031 222/494 |
| D286,747 | S | 11/1986 | Kostanecki | |
| 4,749,108 | A * | 6/1988 | Dornsbusch | B65D 47/2031 222/545 |
| 5,823,387 | A | 10/1998 | Manadanas et al. | |
| 6,065,651 | A | 5/2000 | Tedeschi, Jr. et al. | |
| 6,283,316 | B1 | 9/2001 | Sherman | |
| 6,845,884 | B2 | 1/2005 | Chan et al. | |
| 7,077,296 | B2 * | 7/2006 | Brown | B65D 47/2031 222/212 |
| 8,220,670 | B2 | 7/2012 | Moribata et al. | |
| 11,634,256 | B2 | 4/2023 | Bull | |
| 2007/0095702 | A1 | 5/2007 | Park et al. | |
| 2013/0061851 | A1 | 3/2013 | Jones et al. | |
| 2014/0016988 | A1 | 1/2014 | Bow et al. | |
| 2017/0203884 | A1 | 7/2017 | Sherman et al. | |
| 2018/0127594 | A1 | 5/2018 | Aizenberg et al. | |
| 2020/0390680 | A1 | 12/2020 | Sagel et al. | |

OTHER PUBLICATIONS

All Office Actions: U.S. Appl. No. 18/816,511, filed Aug. 27, 2024.
U.S. Appl. No. 18/816,452, filed Aug. 27, 2024, Tiffany Celeste Hare et al.
U.S. Appl. No. 18/816,511, filed Aug. 27, 2024, Tiffany Celeste Hare et al.
PCT Search Report and Written Opinion for PCT/US2024/046515 dated Jan. 23, 2025, 18 pages.

* cited by examiner

DISPENSING AN ORAL CARE COMPOSITION WITH IMPROVED FLAVOR DISPLAY

TECHNICAL FIELD

The disclosure relates generally to a dispensing an oral care composition and, more particularly, relates to a nozzles, assemblies, and methods for dispensing an oral care composition with improved flavor display.

BACKGROUND

Oral care compositions, such as toothpaste and/or dentifrice compositions, can be applied to the oral cavity to clean and/or maintain the aesthetics and/or health of the teeth, gums, and/or tongue. Additionally, many oral care compositions are used to deliver active ingredients directly to oral care surfaces. Using the right amount of the oral care composition ensures that you have the right amount of active ingredients to provide effective cleaning and removal of plaque, food particles, and bacteria, promoting optimal oral hygiene. For example, many toothpastes contain fluoride, which helps strengthen tooth enamel and prevent tooth decay. Using the correct amount of toothpaste ensures that you receive an effective dose of fluoride and/or the intended amount of aesthetic ingredients (e.g., flavor).

Many commercial toothpaste packages have a flexible tube to contain the toothpaste and a cylindrical nozzle. When a user squeezes the flexible tube, toothpaste is extruded through the cylindrical nozzle and dispensed in the form of a nurdle onto a toothbrush head. Users often apply less toothpaste to their brushes than the recommended dose. There is a need for devices or methods for providing a nurdle of increased weight compared to a conventional circular nozzle without requiring the user to change habits.

SUMMARY

In an embodiment, a method for dispensing an oral care composition includes dispensing the oral care composition through a nozzle to form a dispensed composition. The nozzle includes an orifice having a central axis and an orifice diameter, and fins partially occluding the orifice, where each of the fins has an upper surface and a lower surface. The dispensed composition has an increased flavor display compared to a control dispensed composition made by dispensing the oral care composition through a control nozzle comprising an unobstructed, circular orifice having the orifice diameter.

BRIEF DESCRIPTION OF THE DRAWINGS

While the specification concludes with the claims particularly pointing out and distinctly claiming the invention, it is believed that the present invention will be better understood from the following description taken in conjunction with the accompanying drawings in which:

FIG. 3A is a cross-sectional view of the nozzle of FIG. 1 taken along the line 3A-3A in

FIG. 3.

DETAILED DESCRIPTION

Figure 1:
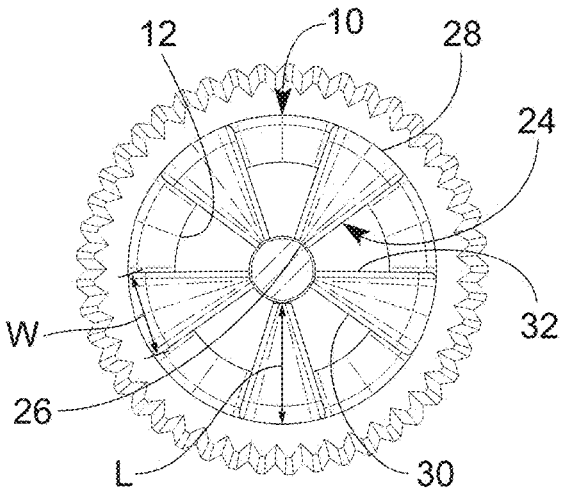
FIG. 1 is a top view of an example embodiment of a nozzle.

Embodiments of the present invention are directed to a partially occluded nozzle that, in use, provides an improved sensory experience including improved flavor display. The nozzle may also provide an improved nurdle weight, an improved aesthetic experience, and improved dispersion of the dispensed oral care composition for the user. Embodiments of the present invention are also directed oral care assemblies comprising a nozzle and a tube as well as methods of making and using such an assembly.

The shape of the nozzle orifice has been discovered to impact toothpaste nurdle output in multiple ways. Modifying the way in which the oral care composition exits the tube has significant impacts on both physical nurdle and consumer sensory experience. For example, creating multiple separate strips at the orifice that join together to form the nurdle on the toothbrush head increases the surface area of the resulting nurdle. This in turn provides an aesthetic benefit by changing the nurdle shape from a simple cylinder to an aesthetic swirl. Additionally, or alternatively, shearing of the oral care composition upon dispensing to the toothbrush, immediately prior to brushing, appears to impact the sensory experience significantly in that it increases flavor display, increases foaming, and improves dispersibility. Without wishing to be bound by theory, it is believed that the shearing, pressurization, off-axis extrusion, alone or in combination, may result in an increase in nurdle weight as discussed further below. Thus, a nozzle according to an embodiment of the present invention can enhance the appearance of the nurdle, increase the size and surface area of the oral care composition that is dispensed, and positively impact the consumer experience of flavor, foamability, and dispersibility. These changes may be aesthetically pleasing and deliver an amount of the oral care composition that is closer to the recommended dose. The improvements in paste characteristics and brushing experience are due to the interaction of the oral care composition with the partially occluded orifice.

Although the following detailed description is given primarily in the context of a nozzle and tube for containing a dentifrice product, it will be understood that the nozzle or tube may be useful for containing and dispensing other oral care or personal care products where it is desirable to provide an increased amount of product, an improved sensory experience, or improved product dispersion compared to a conventional circular orifice.

The section headers below are provided for organization and convenience only.

Definitions

To define more clearly the terms used herein, the following definitions are provided. Unless otherwise indicated, the following definitions are applicable to this disclosure. If a term is used in this disclosure but is not specifically defined herein, the definition from the IUPAC Compendium of Chemical Terminology, 2nd Ed (1997), can be applied, as long as that definition does not conflict with any other disclosure or definition applied herein, or render indefinite or non-enabled any claim to which that definition is applied.

As used herein, "coupled" means "permanently coupled" or "releasably coupled." The term "permanently coupled" is understood to refer to configurations in which a first element is secured to a second element such that the elements generally cannot be separated from one another without at least partially destroying one or both of the elements. The term "releasably coupled" is understood to refer to configurations in which a first element is secured to a second element, such that the first element and the second element can be separated with no or minimal damage to the first and second elements.

The term "oral care composition", as used herein, includes a product, which in the ordinary course of usage, is not intentionally swallowed for purposes of systemic administration of particular therapeutic agents, but is rather retained in the oral cavity for a time sufficient to contact dental surfaces or oral tissues. Examples of oral care compositions include dentifrice, toothpaste, tooth gel, subgingival gel, emulsion, mouth rinse, mousse, foam, mouth spray, lozenge, chewable tablet, chewing gum, tooth whitening strips, floss and floss coatings, breath freshening dissolvable strips, unit-dose composition, fibrous composition, or denture care or adhesive product. The oral care composition may also be incorporated onto strips or films for direct application or attachment to oral surfaces, such as tooth whitening strips. Examples of emulsion compositions include the emulsions compositions of U.S. Pat. No. 11,147,753, jammed emulsions, such as the jammed oil-in-water emulsions of U.S. Pat. No. 11,096,874. Examples of unit-dose compositions include the unit-dose compositions of U.S. Patent Application Publication No. 2019/0343732.

The term "dentifrice composition", as used herein, includes tooth or subgingival-paste, gel, or liquid formulations unless otherwise specified. The dentifrice composition may be a single-phase composition or may be a combination of two or more separate dentifrice compositions. The dentifrice composition may be in any desired form, such as deep striped, surface striped, multilayered, having a gel surrounding a paste, or any combination thereof. Each dentifrice composition in a dentifrice comprising two or more separate dentifrice compositions may be contained in a physically separated compartment of a dispenser and dispensed side-by-side.

"Active and other ingredients" useful herein may be categorized or described herein by their cosmetic and/or therapeutic benefit or their postulated mode of action or function. However, it is to be understood that the active and other ingredients useful herein can, in some instances, provide more than one cosmetic and/or therapeutic benefit or function or operate via more than one mode of action. Therefore, classifications herein are made for the sake of convenience and are not intended to limit an ingredient to the particularly stated function(s) or activities listed.

The term "substantially free" as used herein refers to the presence of no more than 0.05%, preferably no more than 0.01%, and more preferably no more than 0.001%, of an indicated material in a composition, by total weight of such composition.

The term "essentially free" as used herein means that the indicated material is not deliberately added to the composition, or preferably not present at analytically detectable levels. It is meant to include compositions whereby the indicated material is present only as an impurity of one of the other materials deliberately added.

The term "oral hygiene regimen" or "regimen" can be for the use of two or more separate and distinct treatment steps for oral health, e.g., toothpaste, mouth rinse, floss, toothpicks, spray, water irrigator, massager.

While compositions and methods are described herein in terms of "comprising" various components or steps, the compositions and methods can also "consist essentially of" or "consist of" the various components or steps, unless stated otherwise.

As used herein, the word "or" when used as a connector of two or more elements is meant to include the elements individually and in combination; for example, X or Y, means X or Y or both.

As used herein, the articles "a" and "an" are understood to mean one or more of the material that is claimed or described, for example, "an oral care composition" or "a bleaching agent."

All measurements referred to herein are made at about 23° C. (i.e., room temperature) unless otherwise specified.

Several types of ranges are disclosed in relation to embodiments of the present invention. When a range of any type is disclosed or claimed, the intent is to disclose or claim individually each possible number that such a range could reasonably encompass, including end points of the range as well as any sub-ranges and combinations of sub-ranges encompassed therein.

Nozzle

The size and shape of the nozzle helps define a user's experience in dispensing a desired toothpaste volume from the package. A nozzle according to an embodiment of the present invention may provide multiple benefits. For example, the weight of the nurdle may be increased to help deliver an optimal dose of the oral care composition to the user. The oral care composition may be formulated to provide a particular amount of active ingredients (e.g., fluoride) and aesthetic ingredients (e.g., for flavor or foaming). The increased weight of the nurdle due to use of the improved nozzle may lead to superior foaming and flavor display, which may provide an enjoyable brushing experience and leave the mouth feeling clean and refreshed compared to using a smaller-than-recommended amount of the oral care composition. The aesthetics of the nurdle may be improved with a swirled shape compared to a traditional cylindrical nurdle. The user may experience multiple differences during brushing due to the improved nurdle. Some examples include improved foamability, a sense that the oral care composition is lighter, more flavorful, and creamier, and improved dispersibility such that the amount of undispersed oral care composition is reduced at the end of the brushing event.

FIGS. 1-3A illustrate a nozzle 10 according to an embodiment of the present invention. In use, an oral care composition, such as a toothpaste, can be extruded through the nozzle orifice to an exterior of the nozzle 10 (e.g., onto a toothbrush) to create a nurdle. The nozzle 10 may include a nozzle orifice 12 having a central axis 14. The nozzle orifice 12 may be defined by a sidewall 16. The sidewall 16 may have a distal surface or rim 18, an inner surface 20, and an outer surface 22. The rim 18 may be on a plane orthogonal to the central axis 14 of the orifice 12. The rim 18 may be coplanar with the nozzle orifice 12. The thickness of the rim 18 can range from about 0.25 mm to about 4 mm or from about 0.5 mm to about 1.5 mm. The diameter of the orifice 12 may be about 8 mm, about 9 mm, about 10 mm, or may be from about 7 mm to about 11 mm, or from about 8 mm to about 10 mm, or from about 8.5 mm to about 10 mm.

Figure 2:
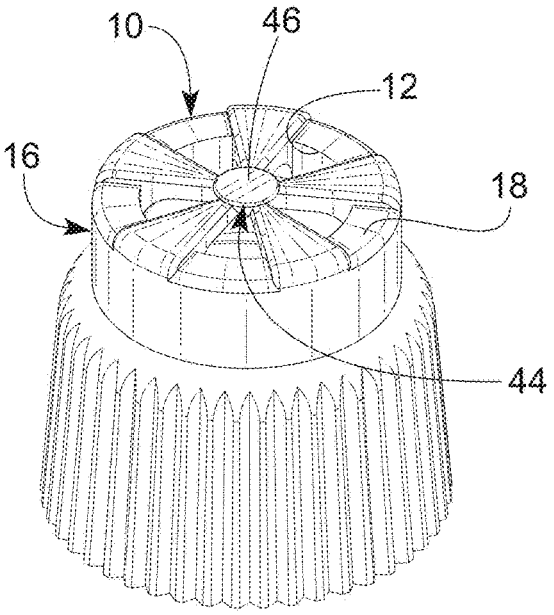
FIG. 2 is a perspective view of the nozzle of FIG. 1.
Figure 3:
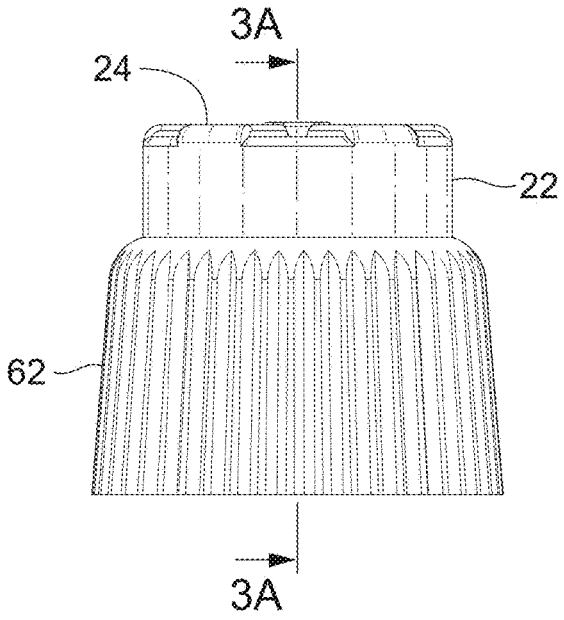
FIG. 3 is a side view of the nozzle of FIG. 1.
Figure 3A:
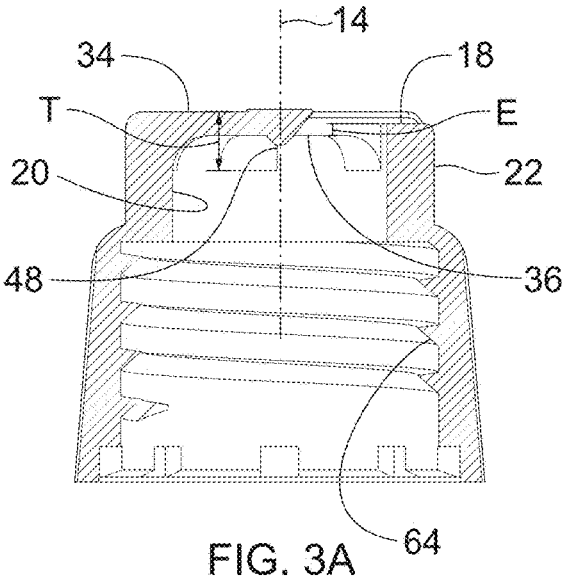

The nozzle orifice 12 may be partially occluded, such as by one or more fins 24. The fins 24 may each extend from an inner end 26 to an outer end 28 and between a first side 30 and a second side 32. The fins 24 may also include an upper surface 34 and a lower surface 36. The fins 24 may be proximal of, distal of, or in line with the orifice 12. In an embodiment, the entire upper surface 34 of the fin 24 may be distal of the orifice 12, and the entire lower surface 36 may be proximal of the orifice 12. In an embodiment, the upper surface 34 may be flat or may be arched (see, e.g., FIG. 6). The lower surface 36 may be, for example, arched or flat (not shown). The fins 24 may be in line with each other or, for example, one or more of the fins 24 may be more proximal or more distal of another fin 24. At least a portion of the fins 24 extend over the orifice 12 to partially occlude the orifice 12. The fins 24 may extend radially outward of the orifice 12 as well. For example, the outer end 28 of the fins 24 may extend to the edge of the rim 18 of the sidewall 16. As shown in FIGS. 2 and 3A, in an embodiment, the fins 24 may extend above and below (or proximal of and distal of) the orifice 12.

Figure 4:
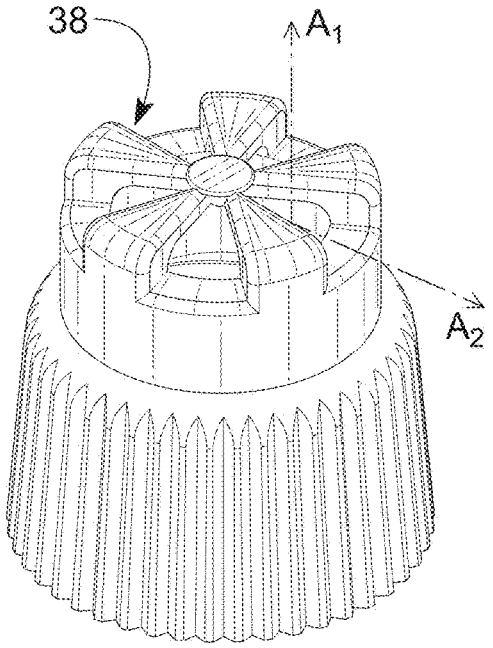
FIG. 4 is a perspective view of an example embodiment of a nozzle.

The fins 24 create openings 38 through which the oral care composition moves when being extruded through the nozzle 10. The openings 38 may be symmetrical or asymmetrical. As shown best in FIGS. 4 and 5, these openings 38 may include on-axis channels 40 and/or off-axis channels 42. The on-axis channel 40 is the space distal of the nozzle orifice 12 extending to a distal end of the fins 24. The off-axis channel 42 corresponds to the axially outside of the orifice 12 and extends to the outer ends of the fins 24. For example, in FIG. 5, the off-axis channel 42 extends from the rim 18 distally to a top of the fins 24, from the inner edge of the rim (the orifice 12) to the outer edge of the rim 18, and between the sides of the fins 24. When the oral care composition is extruded, the portion of the composition moving through the on-axis channels 40 are moving generally parallel to the central axis 14 of the orifice 12 (arrow $A_1$). Referring to FIG. 4, the off-axis channels 42 allow some of the extruded oral care composition to move axially away from the central axis 14 of the orifice 12 (arrow $A_2$). Extruding the oral care composition around the fins 24 and through the off-axis channels 42 both shears and pressurizes the flow of the oral care composition. It has been surprisingly found that the shear and pressurization may result in an increase in nurdle weight. Separately, product shear and reshaping appear to enhance and magnify flavor display, which provides an improved consumer experience when brushing with product extruded through this type of shaped orifice.

Referring to FIGS. 2 and 3A, in an embodiment, the nozzle 10 may include a hub 44 connecting the fins 24. In an embodiment, the hub 44 may be centered relative to the orifice 12 such that a longitudinal axis of the central hub 44 is coaxial with the central axis 14 of the orifice 12. The size and shape of the hub may vary. For example, an upper surface 46 of the hub 44 may be circular. The greatest diameter of the central hub 44 can range, for example, from about 0.5 mm to about 5 mm, from about 1 mm to about 4 mm, or from about 2.5 to about 3.5 mm. The central hub 44 may have a conical shape with a lower point 48, as shown best in FIG. 3A, to direct flow of the oral care composition and encourage side extrusion. In another example, the central hub may be cylindrical or have a flat lower surface. Like the fins 24, the central hub 44 may be elevated relative to the orifice 12. The elevation may also encourage side extrusion of the oral care composition when dispensed. In an example, the upper surface 46 of the central hub 44 may be distal of the orifice 12, and the point 48 or lower surface of the central hub 44 may be proximal of the orifice 12. The central hub 44 may be in the same plane or a different plane as the fins 24. In another embodiment, the fins 24 may be spaced apart such that they do not touch each other (e.g., no central hub is present).

Several parameters, including fin width, thickness, and elevation relative to the orifice, have been found to impact the weight and aesthetics of the nurdle. Without wishing to be bound by theory, it is believed that reshaping the oral care composition as it is extruded by consumers produces an increase in effective nurdle diameter, which in turn increases the dose. Given that benefits such as caries prevention, whitening, cleaning, gingivitis reduction, breath freshening, etc., may be dose-dependent, this attribute provides an advantage for the consumer. This is particularly important when using a smaller toothbrush head, such as those found on most power brushes, where the available surface area on which the product may be dispensed is limited compared to most manual brush heads.

Figure 5:
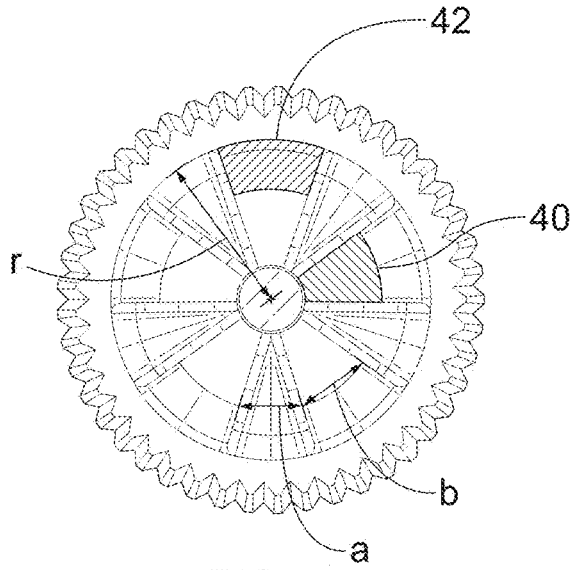
FIG. 5 is a top view of the nozzle of FIG. 4.

The off-axis extrusion area and the total orifice area that is restricted can vary. The off-axis extrusion area can range from 0 $mm^2$ to about 1 $cm^2$, 0 $mm^2$ to about 25 $mm^2$, from about 0 $mm^2$ to about 5 $mm^2$, or from about 3.9 to about 16.4 $mm^2$. In an embodiment where the fins are sector or pie-piece shaped, the off-axis extrusion area may be approximated by the product of: the number of fins (n), the distance that the top of the fin protrudes distally beyond the orifice, and the approximate width of the opening between fins (b). The approximate width of the opening between fins (b) can be calculated according to the following equation:

$$b = \frac{(2\pi r - an)}{n}$$

where "r" is a radial distance from the center of the orifice to the outer circle defined by the ends of the fins, "n" is the number of fins, and "a" is the fin width at inner edge of orifice. FIG. 5 shows "r," "a," and "b" in an example embodiment. The off-axis extrusion area may be divided into low-pressure and high-pressure areas.

The total orifice surface area that is restricted (e.g., by the fins 24 and the optional hub 44) can range from about 10% to about 90%, from about 40% to about 60%, from 38.3% to about 58.9%, from about 44.6% to about 49.6%, from about 45% to about 50%, or about 46% to about 48% of the total orifice surface area.

The number of the fins 24 may vary. The nozzle 10 may include, without limitation, 1 fin, 2 fins, 3 fins, 4 fins, 5 fins, 6 fins, 7 fins, or more than 7 fins. The nozzle 10 may include, without limitation, from 1 to 10 fins, from 3 to 7 fins, or from 4 to 6 fins.

The length of the fins 24 may vary. The fins 24 may have the same length or may have different lengths. FIG. 1 shows the length, L, of a fin 24. In some embodiments, the length or greatest length of the fins 24 can range from about 1 mm to about 7 mm, from about 3.25 to about 4.5 mm, or from about 3.5 to about 4 mm.

The width of the fins 24 may vary. The fins 24 may have the same width or may have different widths. The width of the fins 24 may be constant or may vary along the fin 24. The variation in width of the fins may be constant or variable. For example, as shown in FIG. 1, the sides of the fins 24 are linearly tapered inward from a greatest width, W, towards the central hub 44. In another example, the sides of the fins 24 may bow outwardly or inwardly. In some embodiments, the width or greatest width of the fins 24 may be from about 0.5 mm to about 6 mm, from about 1 mm to about 5 mm, from about 3 mm to about 5 mm, from about 3.25 mm to about 4.5 mm, or from about 3.25 mm to about 4 mm.

The thickness of the fins 24 may vary. The fins 24 may have the same thickness or may have different thicknesses. The thickness of the fins 24 may be constant or may vary along the fin 24. For example, as shown in FIG. 3A, the thickness of the fins 24 decrease from a greatest thickness, T, towards the central hub 44. In some embodiments, the thickness or greatest thickness of the fins 24 can range from about 0.1 mm to about 10 mm, from about 0.25 mm to about 5 mm, from about 0.25 to about 2 mm, or from about 0.5 to about 1.5 mm.

The elevation of the fins 24 relative to the orifice 12 may vary. The elevation of the fins 24 may be measured from the lower surface 36 of the fin 24 to the rim 18 or, if a rim is not present, the distal-most edge of the orifice 12. FIG. 3A shows an elevation, E, of the fins 24. In some embodiments, the elevation or greatest elevation can range from about −5 mm to about 5 mm, from about −2 mm to +1 mm, from about −1 mm to about 0 mm, from about −0.5 to about 0 mm, from about 0 mm to about 0.5 mm. With reference to FIGS. 4 and 5, an example embodiment of a nozzle 10 is shown where the fins 24 are elevated above the nozzle orifice 12.

Figure 6:
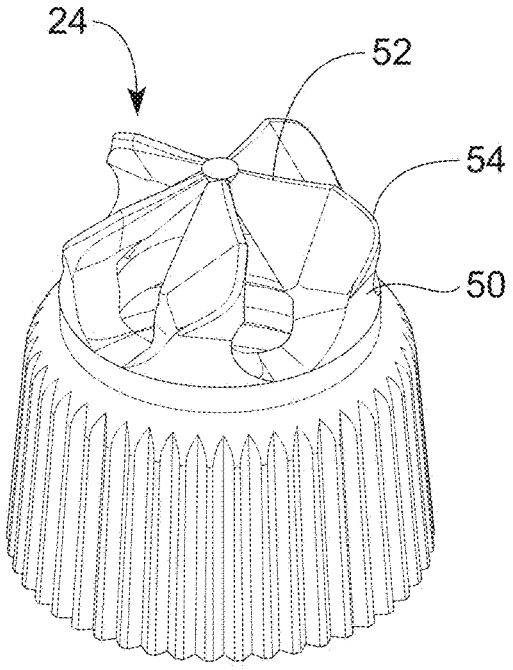
FIG. 6 is a perspective view of an example embodiment of a nozzle.

The shape of the fins 24 may vary. In another embodiment, the fins may have a triangular, rectangular, or curved shape or may be shaped like a fan blade or propeller. As shown in FIGS. 1 and 5, in an embodiment, the shape of the fins 24 may be a sector or pie-piece shape. The fins 24 may extend from the rim 18 over the orifice 12. The fins 24 may be coupled to the central hub 44. The fins 24 and central hub 44 may form a wagon wheel shape. In another embodiment, the fins 24 may be arched and coupled to the central hub 44 to form a dome shape (e.g., as shown in FIG. 6). In another embodiment, the fins 24 may have ends that are not coupled to another portion of the nozzle 10. In an embodiment not including a rim, the fins 24 may be coupled to the nozzle 10 adjacent an edge of the orifice 12 and extend distally of the orifice 12. The fins 24 may be inclined at an angle relative to a central axis 14 of the orifice 12 or may be at a right angle to the central axis 14 (as shown in FIGS. 2 and 3A).

Figure 7:
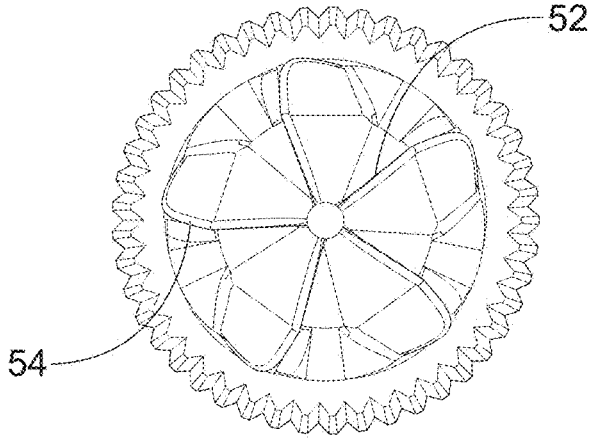
FIG. 7 is a top view of the nozzle of FIG. 6.

Referring to FIGS. 6 and 7, in another embodiment, the shape of the fins 24 may be similar to a curved fan blade shape. For example, the fins 24 may have a longitudinal portion 50, an axial portion 52, and a transitional portion 54 therebetween. The longitudinal portion 50 may be coupled to the rim 18 and extend distally of the rim 18. In an embodiment not including a rim, the longitudinal portion 50 may be coupled to the nozzle 10 adjacent an edge of the orifice 12 and extend distally of the orifice 12. In the illustrated embodiment, the longitudinal portion 50 does not extend over the orifice 12. In another embodiment, the longitudinal portion 50 may extend over the orifice 12.

The axial portion 52 may extend towards the central axis 14 of the orifice. In other words, the axial portion 52 may extend over and partially occlude the orifice 12. The axial portion 52 may extend to the central hub 44 if present. In an embodiment where a central hub is not present, the end of the axial portion 52 may freely hang over the orifice 12 or may join with the axial portion 52 of another fin 24. The axial portion 52 may be inclined at an angle relative to a central axis 14 of the orifice 12. The inclination angle of the axial portion 52 may vary over a length of the axial portion 52. The inclination angle may be from about 0° to about 90°, between about 0° to about 60°, between about 15° to about 90°, between about 40° to about 50°, or may be about 0° or about 45°. In another embodiment, the axial portion 52 may be at a right angle relative to the central axis 14 of the orifice 12.

The transitional portion 54 extends between the longitudinal portion 50 and the axial portion 52. The transitional portion 54 may be curved and twisted. At least a portion of the transitional portion 54 may be inclined relative to a central axis 14 of the orifice 12. In various embodiments, the transitional portion 54 may partially occlude the orifice 12 or may not occlude the orifice 12.

Where the first and second sides 30, 32 of the fins 24 are not coplanar, the first and second sides 30, 32 may define a leading edge and a trailing edge, respectively. The trailing edge at the axial portion 52 may be distal of the leading edge at the axial portion 52. When being extruded through the nozzle, the oral care composition may first contact the leading edge before the trailing edge.

The width and thickness of the longitudinal portion 50, the axial portion 52, and the transitional portion 54 may vary. For example, a thickness of the transitional portion at the trailing edge may be greater than a thickness of the transitional portion at the leading edge. The thickness of the longitudinal portion 50 may be greater than the thickness of the end of the axial portion 52. Similarly, the width of the longitudinal portion 50 may be greater than the width of the end of the axial portion 52.

Cap

Figure 8:
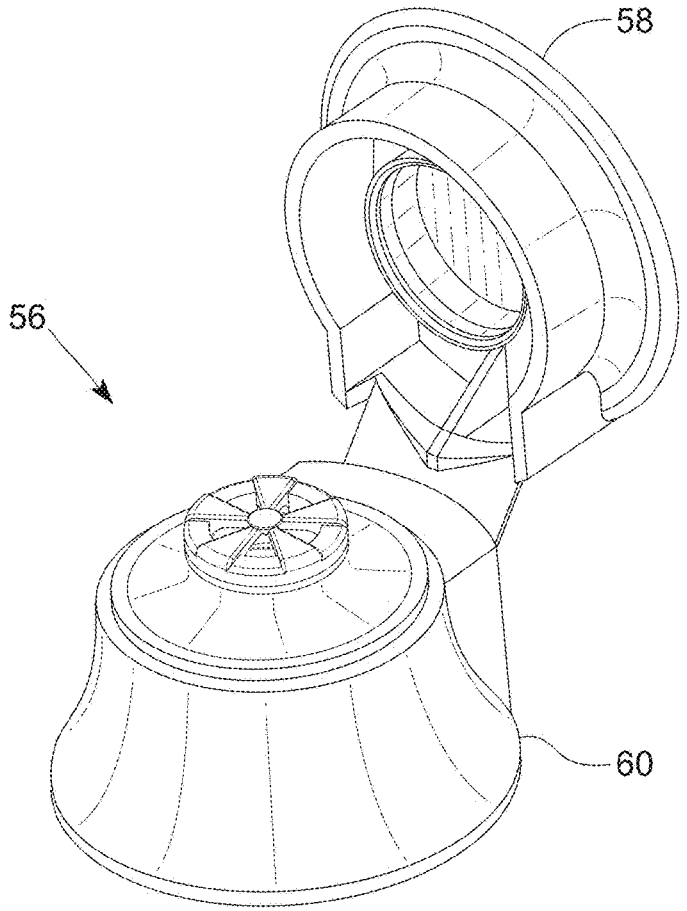
FIG. 8 is a perspective view of an example embodiment of a flip-top style cap.

A nozzle, according to some embodiments, may be coupled to or integral with a cap. As shown in FIG. 8, in an embodiment, the cap may be a flip-top style cap 56 with a lid 58 that is hinged to the cap body 60. The cap body 60 may be configured to be releasably coupled with a container or tube.

The form of the cap may vary. The nozzle may act as a cap on a tube. The example nozzles shown in FIGS. 1-7 are depicted with a fez-style skirt extending proximally therefrom. For example, as shown in FIG. 3A, the skirt 62 may flare slightly outward from the nozzle 10 to a proximal end of the skirt 62. The outer surface of the skirt 62 may be smooth or may be textured, such as ridged. The skirt may be removably coupled with a tube, for example, using interior threads 64.

Alternatively, the nozzle may be separate from the cap. For example, the nozzle may be coupled to or integral with a tube, as discussed below. In such an embodiment, the cap may be a conventional cap, such as a screw-on style cap (e.g., a fez cap).

Tube

Figure 9:
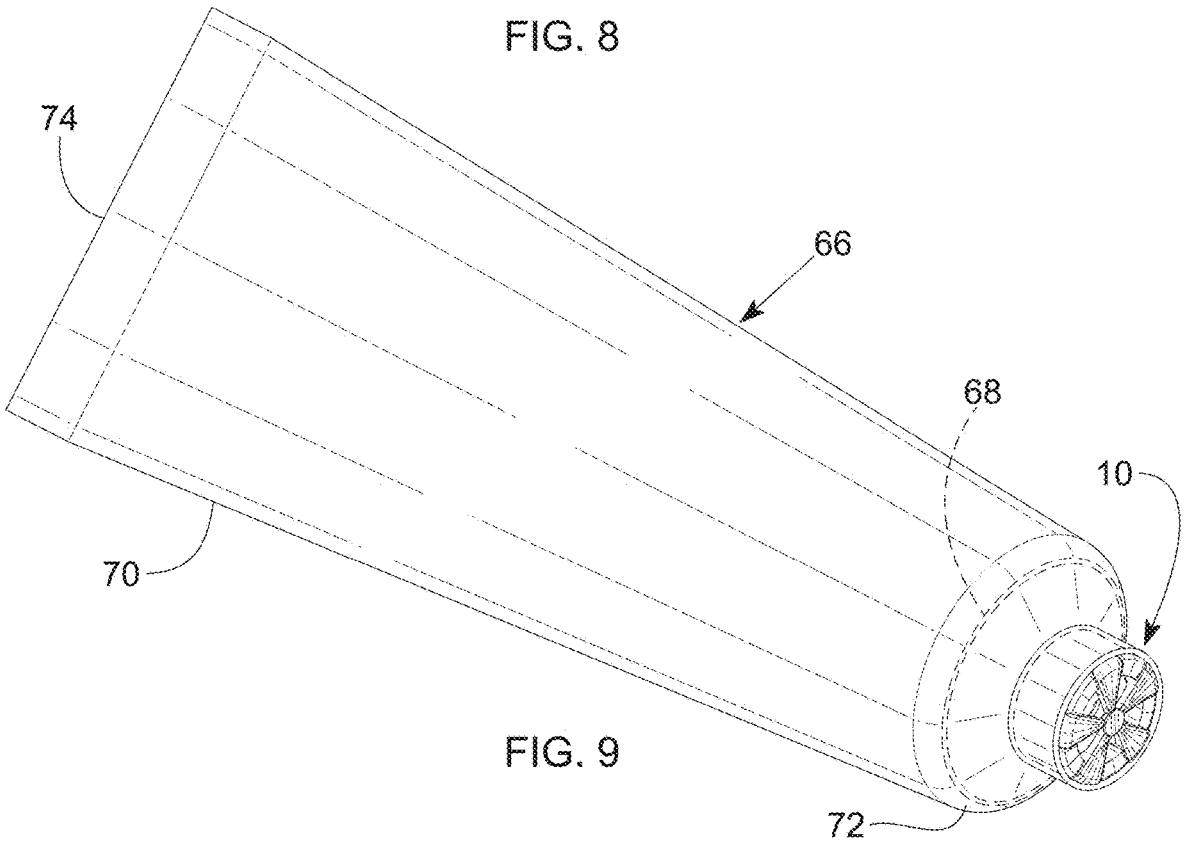
FIG. 9 is a perspective view of an example embodiment of a tube.

An oral care assembly may include a tube, a nozzle, and a cap. FIG. 9 illustrates, according to an example embodiment, a reservoir or tube 66 and a nozzle, such as nozzle 10. The tube 66 may contain an oral care composition, such as a toothpaste. A longitudinal axis of the tube or assembly, the central axis 14 of the orifice 12, and a direction of flow of the oral care composition may be, for example, parallel or coaxial. As shown in FIG. 9, the nozzle 10 may be integral with or coupled to the tube 66. For example, if the nozzle 10 is coupled to the tube 66, the nozzle 10 may extend from an insert 68 secured inside the tube 66. In other embodiments, the nozzle 10 may be integral with or coupled to the cap (e.g., cap 56 in FIG. 8). When a cap is coupled to the tube 66 or otherwise closed, the tube 66 is sealed such that the contents of the tube are prevented from leaking under normal conditions.

The tube 66 may include a tube body 70 that is squeezable by a user to extrude the contained oral care composition through the nozzle 10. The tube body 70 may have a shoulder 72. In embodiments where the nozzle 10 is not integral with the tube 66, the tube 66 may include a tube orifice. In embodiments where the nozzle 10 is integral with the tube 66, the nozzle orifice 12 may act as the tube orifice. When the tube is squeezed, the contents of the tube pass through the tube orifice and/or the nozzle orifice 12 to an exterior of the assembly (e.g., onto a toothbrush). The tube body 70 may be sealed by a crimp seal 74 at one end, such as the end of the tube 66 that is opposite from the shoulder 72 or the tube orifice.

The tube 66 may be configured to be releasably coupled with a cap (e.g., cap 56). For example, the tube 66 and cap may include corresponding threads. The cap may include threads (e.g., threads 64 in FIG. 3A) that are configured to be releasably coupled with the threads (not shown) on the tube 66. In an embodiment, the tube 66 may include threads on an exterior surface thereof, and the cap may include threads on an interior surface thereof. In another embodiment, the cap may be configured to snap onto the tube 66.

The tube, the nozzle, and the cap may be made of the same material or be made of different materials. The tube, the nozzle, and the cap may be made of any materials known to those of skill in the art that provide adequate storage of the dentifrice or other product contained in the tube. The materials comprising the assembly should have no reaction with the components that comprise the contents, such that the contents could be rendered unsafe or otherwise unsuitable for consumer use. The materials should, of course, also be durable enough to withstand normal consumer use without leakage, tearing or breakage, etc. The materials may be able to protect the oral care composition from environmental variables (e.g., humidity or light) that may damage the composition over an expected shelf life.

For containing a dentifrice product, non-limiting examples of suitable materials from which the assembly or components thereof may be made of include polyethylenes, such as low density polyethylene ("LDPE"), linear low density polyethylene ("LLDPE"), medial density polyethylene ("MDPE"), and high density polyethylene ("HDPE"), ethylene acrylic acid ("EAA"), foils, such as aluminum foil, or any of the above materials in any combination, for example, formed as a laminate structure. The thickness of the side walls of the tube body may be, for example, from about 0.1 mm to about 0.4 mm, or about 0.3 mm. It is possible to provide thicker or thinner sidewalls, but it is believed that such would not be particularly cost-effective and would not necessarily provide additional dispensing benefits. The material may be a laminate material.

While the description herein is mainly given in the context of a tube having a single interior chamber, it is understood that the body of the present invention may be divided into multiple chambers, each chamber housing a component portion of a composition. Such embodiments are within the scope of the present invention.

Flavor Release

Using a nozzle as described herein to extrude toothpaste may result in improved sensory characteristics. For example, the flavor release or display may be increased when using a nozzle according to an embodiment of the present invention compared to a conventional nozzle with an unobstructed circular orifice having a same diameter. The flavor release may be improved in the nurdle itself (e.g., neat toothpaste) or in a slurry. For example, while the toothpaste becomes a slurry during brushing, the flavor release may be improved compared to a toothpaste dispensed from a conventional circular orifice. The flavor release may be measured as the sum of the total ion chromatogram (TIC) peak areas of flavor components measured in the headspace.

The increase in overall flavor release (neat) from dentifrice, when extruded from a nozzle according to an embodiment of the present invention, after about 15 seconds may be, for example, at least 10%, at least 20%, at least 30%, at least 40%, at least 50%, at least 60%, or at least 70%, or in a range of about 10% to about 90% or about 15% to about 75% higher than the flavor intensity measured when the same dentifrice from the same tube is extruded through a conventional circular orifice. The increase in overall flavor release (neat) at about 30 seconds may be, for example, at least 10%, at least 20%, at least 30%, at least 40%, at least 50%, at least 60%, or at least 70%, or in a range of about 10% to about 90% or about 15% to about 85%. The increase in overall flavor release (neat) at about 60 seconds may be, for example, at least 10%, at least 20%, at least 30%, at least 40%, at least 50%, at least 60%, or at least 70%, or in a range of about 10% to about 90% or about 40% to about 50%.

The increase in overall flavor release (slurry) at about 15 seconds may be, for example, at least 10%, at least 20%, or at least 30%, or in a range of about 5% to about 40%, about 10% to about 35%, about 15% to about 30%, or about 18% to about 27%.

The effect on flavor release may also be measured for individual flavor components. The flavor components may include, without limitation, alpha-pinene, beta-pinene, limonene, eucalyptol, menthone, isomenthone, menthyl acetate, menthol, carvone, anethole, myrcene, p-cymene, and combinations thereof. Some individual components may have a greater increase in flavor release compared to others. For example, the change in flavor release of alpha-pinene up to about 60 seconds may be at least 50%, at least 100%, or at least 200%, or in a range from about 50% to about 400%. The change in flavor release of beta-pinene up to about 60 seconds may be, for example, at least 50%, at least 100%, or at least 250%, or in a range from about 50% to about 350%. In another example, the change in flavor release of limonene up to about 60 seconds may be at least 60%, at least 150%, or at least 300%, or in a range from about 60% to about 425%. For eucalyptol, the change in flavor release up to about 60 seconds may be, for example, at least 30%, at least 75%, or at least 100%, or in a range from about 30% to about 130%. The change in flavor release of menthone up to about 60 seconds may be, for example, at least 25%, at least 50%, or at least 75%, or in a range from about 25% to about 100%. In another example, the change in flavor release of isomenthone up to about 60 seconds may be at least 10%, at least 50%, or at least 70%, or in a range from about 10% to about 85%. For menthyl acetate, the change in flavor release up to about 60 seconds may be, for example, at least 10%, at least 50%, or at least 100%, or in a range from about 10% to about 120%. The change in flavor release of menthol up to about 60 seconds may be, for example, greater than 0%, at least 25%, or at least 60%, or in a range from about-5% to about 75%. In another example, the change in flavor release of carvone up to about 60 seconds may be at least 10%, at least 50%, or at least 70%, or in a range from about 10% to about 80%. For anethole, the change in flavor release up to about 60 seconds may be, for example, at least 20%, at least 50%, or at least 70%, or in a range from about 20% to about 80%. The change in flavor release up to about 30 seconds for individual compounds may be greater than 0%, at least 30%, or at least 50%, or in a range from about-7% to about 65% in a slurry.

Oral Care Composition

The oral care composition can be in any suitable form, such as a solid, liquid, powder, paste, or combinations thereof. The oral care composition can be dentifrice, tooth gel, subgingival gel, mouth rinse, mousse, foam, mouth spray, lozenge, chewable tablet, chewing gum, tooth whitening strips, floss and floss coatings, breath freshening dissolvable strips, or denture care or adhesive product. The components of the dentifrice composition can be incorporated into a film, a strip, a foam, or a fiber-based dentifrice composition.

The oral care composition can include a variety of active and inactive ingredients, such as, for example, but not limited to a hops extract, a dicarboxylic acid, a calcium ion source, water, a fluoride ion source, a metal source such as a tin ion source and/or a zinc ion source, an antibacterial agent, a bioactive material, a potassium source, a quaternary ammonium compound, a polyphosphate, a humectant, a surfactant, a buffering agent, a monodentate ligand, a polydentate ligand, a thickening agent, an abrasive, an amino acid such as a neutral amino acid or a basic amino acid, a whitening agent, and the like, as well as any combination thereof. The oral care composition can include one or more of the active and inactive ingredients as described in U.S. U.S. Pat. No. 11,696,881 or U.S. Patent Publication No. 2021/0346259, each of which is herein incorporated by reference in its entirety.

The nozzle or assembly described herein may be particularly useful for use with an oral care composition having a viscosity range from 150,000 centipoise to 850,000 centipoise ("cP"). A method for assessing viscosity is described. The viscometer is Brookfield® viscometer, Model DV-I Prime with a Brookfield "Helipath" stand. The viscometer is placed on the Helipath stand and leveled via spirit levels. The E spindle is attached, and the viscometer is set to 2.5 RPM. Detach the spindle, zero the viscometer and install the E spindle. Then, lower the spindle until the crosspiece is partially submerged in the paste before starting the measurement. Simultaneously turn on the power switch on the viscometer and the helipath to start rotation of the spindle downward. Set a timer for 48 seconds and turn the timer on at the same time as the motor and helipath. Take a reading after the 48 seconds. The reading is in cP.

Oral Care Composition Forms

Suitable compositions forms include emulsion compositions, such as the emulsions compositions of U.S. Pat. No. 11,147,753, which is herein incorporated by reference in its entirety, unit-dose compositions, such as the unit-dose compositions of U.S. Patent Application Publication No. 2019/0343732, which is herein incorporated by reference in its entirety, leave-on oral care compositions, jammed emulsions, such as the jammed oil-in-water emulsions of U.S. Pat. No. 11,096,874, which is herein incorporated by reference in its entirety, dentifrice compositions, mouth rinse compositions, mouthwash compositions, tooth gel, subgingival gel, mouth rinse, mousse, foam, mouth spray, lozenge, chewable tablet, chewing gum, tooth whitening strips, floss and floss coatings, breath freshening dissolvable strips, denture care products, denture adhesive products, or combinations thereof.

Methods

The oral care compositions, as described herein, can lead to oral health benefits, such as the treatment, reduction, and/or prevention of caries, cavities, gingivitis, and/or combinations thereof and/or the whitening of teeth, removing stain from teeth, and/or preventing the accumulation of stain from teeth when applied to the oral cavity. For example, a user can dispense at least a one-inch strip or nurdle of a suitable oral care composition, as described herein, onto an oral care implement, such as a toothbrush, applicator, and/or tray, and applied to the oral cavity and/or teeth. Using a nozzle as described above, dispensing the oral care composition may include on-axis extrusion and off-axis extrusion of the oral care composition.

The user can be instructed to brush teeth thoroughly for at least 30 seconds, at least one minute, at least 90 seconds, or at least two minutes at least once, at least twice, or at least three times per day. The user can also be instructed to expectorate the oral care composition after the completion of the brush procedure.

The user can also be instructed to rinse with a mouthwash and/or mouth rinse composition after the completion of the brush procedure or instead of the brush procedure. The user can be instructed to swish the oral care composition thoroughly for at least 30 seconds, at least one minute, at least 90 seconds, or at least two minutes at least once, at least twice, or at least three times per day. The user can also be instructed to expectorate the oral care composition after the completion of the procedure.

The oral care compositions according to embodiments of the present invention can be used in the treatment, reduction, and/or prevention of caries, cavities, gingivitis, and/or combinations thereof. The oral care compositions according to embodiments of the present invention can be used to provide a whitening benefit, such as the whitening of teeth, removing stain from teeth, and/or preventing the accumulation of stain on teeth.

The oral care composition can include primary packaging, such as a tube, bottle, and/or tub. The primary package can be placed within secondary package, such as a carton, shrink wrap, or the like. Instructions for use of the oral care composition can be printed on the primary package and/or the secondary package. The scope of the method is intended to include instructions provided by a manufacturer, distributor, and/or producer of the oral care composition.

If the oral care composition is a toothpaste, the user can be instructed to dispense the toothpaste from the toothpaste tube.

The user can be instructed to apply a portion of the toothpaste onto a toothbrush. The portion of the toothpaste can be of any suitable shape, such as strip, a pea-sized amount, or various other shapes that would fit onto any mechanical and/or manual brush head. The user can be instructed to apply a strip of the toothpaste that is at least about 1 inch, at least about 0.5 inch, at least 1 inch, and/or at least 0.5 inch long to the bristles of a toothbrush, such as soft-bristled toothbrush.

The user can be instructed to apply pea-sized or grain of rice-sized portion of the toothpaste to the bristles of a toothbrush, such as in the case of use by children of less than 6 years old and/or less than 2 years old.

The user can be instructed to brush their teeth for at least about 30 seconds, at least about 1 minute, at least about 90 seconds, at least about 2 minutes, at least 30 seconds, at least 1 minute, at least 90 seconds, and/or at least 2 minutes.

The user can be instructed to brush their teeth thoroughly and/or as directed by a physician and/or dentist.

The user can be instructed to brush their teeth after each meal. The user can be instructed to brush their teeth at least once per day, at least twice per day, and/or at least three times per day. The user can be instructed to brush their teeth no more than three times a day, such as to prevent Sn staining. The user can be instructed to brush their teeth in the morning and/or in the evening prior to sleeping.

The user can be instructed to not swallow the toothpaste composition due to the inclusion of ingredients that are not suitable for ingestion, such as fluoride. However, in the case of an oral care composition comprising hops, but free of fluoride, the user may not need to be instructed to not swallow the toothpaste. The user may be instructed to expectorate (or spit out) the toothpaste composition after the cessation of the brushing cycle.

The user can be instructed to use the mouth rinse at least once a day, at least twice a day, and/or at least three times a day.

The user can be instructed to use the mouth rinse composition after the use of toothpaste and/or floss.

The user can be instructed to swish a portion of rinse in the oral cavity, such as between the teeth, for a period of time. The user can be instructed to vigorously swish a portion of the rinse.

The user can be instructed to use be from about 5 mL to about 50 mL, from about 10 mL to about 40 mL, 10 mL, 20 mL, 25 mL, 30 mL, 40 mL, 2 teaspoonfuls, and/or 4 teaspoonfuls of mouth rinse.

The user can be instructed to swish the mouth rinse for at least about 30 seconds, at least about 1 minute, at least about 90 seconds, at least about 2 minutes, at least 30 seconds, at least 1 minute, at least 90 seconds, and/or at least 2 minutes.

The user can be instructed to not swallow the mouth rinse composition due to the inclusion of ingredients that are not suitable for ingestion, such as fluoride. However, in the case of an oral care composition comprising hops, but free of fluoride, the user may not need to be instructed to not swallow the mouth rinse. The user may be instructed to expectorate (or spit out) the mouth rinse composition after the cessation of the rinse cycle.

The usage instructions for the oral care composition, such as for a toothpaste composition and/or a mouth rinse composition, can vary based on age. For example, adults and children that are at least 6 or at least 2 can have one usage instruction while children under 6 or under 2 can have a second usage instruction.

Additionally, the oral care composition, as described herein, can be used to reduce the number and/or intensity of white spots on teeth, which can be attributable to caries presence within the oral cavity. Or the oral care composition, as described herein, can be used to reduce the redness, puffiness, tenderness, and/or swollenness of gums at the gumline immediately adjacent the surfaces of the teeth, which can be attributable to gingivitis presence within the oral cavity.

Combinations

A. A method for dispensing an oral care composition comprising:
   - dispensing the oral care composition through a nozzle to form a dispensed composition, wherein the nozzle comprises:
   - an orifice having a central axis and an orifice diameter; and
   - fins partially occluding the orifice, wherein each of the fins has an upper surface and a lower surface,
   - wherein the dispensed composition has an increased flavor display compared to a control dispensed composition made by dispensing the oral care composition through a control nozzle comprising an unobstructed, circular orifice having the orifice diameter.

B. The method as disclosed in A, wherein a center of the orifice is occluded.

C. The method as disclosed in A or B, further comprising a central hub, wherein the fins are coupled to the central hub.

D. The method as disclosed in A, wherein the fins are not in contact with a central hub.

E. The method as disclosed in any one of A-D, wherein the upper surface of each of the fins is distal of the orifice.

F. The method as disclosed in any one of A-E, wherein the lower surface of each of the fins is proximal of the orifice.

G. The method as disclosed in any one of A-E, wherein the lower surface of each of the fins is distal of the orifice.

H. The method as disclosed in any one of A-G, further comprising an on-axis extrusion area and an off-axis extrusion area.

I. The method as disclosed in any one of A-H, further comprising a sidewall defining the orifice, wherein the sidewall comprises an inner wall, a rim, and an outer wall.

J. The method as disclosed in I, wherein each of the fins further comprise an outer end that extends to the outer wall of the sidewall.

K. The method as disclosed in J, wherein the lower surface of each of the fins extends from the inner surface of the sidewall.

L. The method as disclosed in any one of A-K, wherein the improved flavor display comprises an increase in a sum of mean peak area of headspace flavor components measured from the dispensed composition.

M. The method as disclosed in L, wherein the improved flavor display is measured at 15 seconds, 30 seconds, or 60 seconds after enclosing the dispensed composition.

N. The method as disclosed in L or M, wherein the increase in the sum of mean peak area of headspace flavor components is in a range of about 10% to about 90%.

O. The method as disclosed in any one of A-N, wherein the improved flavor display comprises an increase in a sum of mean peak area of headspace flavor components measured from the dispensed composition in a slurry.

P. The method as disclosed in O, wherein the improved flavor display is measured at 15 seconds after forming the slurry.

Q. The method as disclosed in O or P, wherein the increase in the sum of mean peak area of headspace flavor components is in a range of about 5% to about 40%.

R. The method as disclosed in any one of A-Q, wherein the improved flavor display comprises an increase in a mean peak area of limonene, preferably wherein the increase is at least 60%.

S. The method as disclosed in any one of A-R, wherein the improved flavor display comprises an increase in a mean peak area of alpha-pinene, preferably wherein the increase is at least 50%.

Examples

The invention is further illustrated by the following examples, which are not to be construed in any way as imposing limitations to the scope of this invention. Various other aspects, modifications, and equivalents thereof which, after reading the description herein, may suggest themselves to one of ordinary skill in the art without departing from the spirit of the present invention or the scope of the appended claims.

Flavor Display Measurement Method

The effect of the nozzle design on flavor display was assessed using a Comparative Nozzle and an Inventive Nozzle. The Comparative Nozzle has a circular, unobstructed orifice with a diameter of about 9 mm. The Inventive Nozzle, as shown in FIG. 1, has an orifice diameter or about 9 mm, 5 fins having a length of about 6 mm, a width of about 3.75 mm, and a thickness of about 1 mm, a central hub having a diameter of about 3 mm, and a fin elevation of about-0.5 mm. The Inventive Nozzle has an on-axis extrusion area of about 33.6 $mm^2$ and a percent restriction of about 47.1. Samples for evaluating changes to flavor display from a given dentifrice were prepared by squeezing a toothpaste sample from the same tube of dentifrice through either the Comparative Nozzle or the Inventive Nozzle into a 125 mL glass jar with Teflon lined lid, on which there is a septum (Thermo Fisher Scientific, Rockwood, TN, USA; part number 00051558) for flavor display measures. The samples weighed 3.0 g (+/−0.1 g), as measured using a Mettler Toledo XSE 205 DualRange balance (Mettler Toledo USA, Columbus, OH, USA).

Flavor display is measured from neat toothpaste or a slurry of toothpaste, with the latter condition to simulate flavor display during brushing. For measuring the flavor display of a neat toothpaste, once the 3.0 g sample is weighed, the jar is immediately sealed with the lid. At 15, 30, or 60 seconds after closing the lid, flavor components in the headspace are sampled with a 1-cm Divinylbenzene/Carboxen/Polydimethylsiloxane (DVB/CAR/PDMS) triphase Solid Phase Microextraction (SPME) fiber (Sigma-Aldrich Inc., St. Louis, MO, USA; part number 57329-U). The SPME fiber is inserted into the glass jar through the septum on the Teflon-lined lid between 0.5" and 1.2", and headspace is collected for 15 seconds at ambient temperature. The SPME fiber is withdrawn and inserted into the GC inlet where the flavor components are desorbed at 250° C. for 5 min and analyzed via Gas Chromatography-Mass Selective Detector (GC-MSD) analysis on a system configured with Agilent 7890A GC, Agilent 5975 single quadrupole mass spectrometer (Agilent Technologies Inc, Santa Clara, CA, USA).

For measuring the flavor display of a slurry of toothpaste, 3.0 g (+/−0.1 g) of sample is weighed into a 125-mL glass jar with a 5-cm magnetic stir bar (VWR International, Radnor, PA, USA; part number 30620-478). Then 5.0 mL of artificial saliva salt solution (see composition in TABLE 1 and the brief preparation procedure below) are immediately added into the jar with a 5-mL pipette, followed by sealing the jar with the Teflon-lined lid with septum. The mixture is stirred for 30 seconds using a Corning PC-353 stirrer (Corning Incorporated Life Sciences, Glendale, AZ, USA) at about 250 rpm to release flavor from the toothpaste slurry. The flavor components are captured from the headspace with a 1-cm DVB/CAR/PDMS triphase SPME fiber by inserting the SPME fiber into the glass jar through the septum on the lid between 0.5" to 1.0" for 15 seconds. The SPME fiber is then placed into the GC inlet and the flavor components are desorbed for GC/MS analysis as described above.

TABLE 1

Composition of Artificial Saliva Salt Solution (1000 mL)

| Chemicals | Formula | Weight (±0.0002 g) |
|---|---|---|
| Sodium Bicarbonate | $NaHCO_3$ | 1.6800 |
| Potassium Phosphate Dibasic | $K_2HPO_4$ | 0.4791 |
| Potassium Phosphate Monobasic | $KH_2PO_4$ | 1.6604 |
| Sodium Chloride | NaCl | 0.8760 |

Using a Mettler Toledo XSE 205 DualRange balance (Mettler Toledo USA, Columbus, OH, USA), weigh each salt described in Table 1 into a 600-mL beaker. Dissolve the salts with approximate 300 mL deionized (DI) water with a resistivity of 18.2 MΩ·cm at 25 C from a Milli-Q® direct water purification system (MilliporeSigma, Rockville, MD, USA; part number ZROQ016WW) and transfer into a 1000-mL volumetric flask. Then rinse the beaker with approximately 200 mL DI water three times and transfer each of the water rinses into the 1000-mL flask. Finally, add more DI water to the mark and mix the solution well by inversion and shaking.

GC/MS Analysis Method

Headspace flavor components captured by SPME fiber were analyzed by GC-MSD via conditions described in the following sections: (i) gas chromatography (GC) separation conditions; (ii) mass spectrometer data acquisition; and (iii) mass spectrometer data processing.

Gas Chromatography Separation Conditions. The GC injector is configured with a Merlin Microseal septum (Restek, Bellefonte, PA, USA, part number 22810) with a glass injector liner of dimensions 4×6.3×78.5 mm and containing glass wool (Restek, Bellefonte, PA, USA; part number 20782-213.5). The SPME fiber is inserted into the GC inlet and desorbed for 5 minutes at a temperature of 250° C., and the sample is transferred to the column in splitless mode with a helium carrier gas; the initial column pressure is about 15.764 psi (108.69 kPa) and the column flow rate is about 1.14-mL helium/minute. The GC is run in constant-flow mode throughout the analytical portion of the analysis and separation is achieved with an Agilent J&W HP FFAP column with dimensions of 30 m×0.25 mm ID×0.25 micro-m film thickness (Agilent HP FFAP column; part number 19091F-433). Initially, the GC oven temperature is held at 40° C. for 1.0 minute, then ramped at 10° C./minute to 220° C. and held at 220° C. for 2.0 minutes. The GC run time is 21 minutes. The oven temperature is then cooled to 40° C. to prepare for the subsequent injection. Prior to headspace flavor component analysis, columns are conditioned per manufacturer recommendations and analysis of a blank SPME fiber is performed under the same conditions to assure no carry over from previous injections.

Mass Spectrometer Data Acquisition. Effluent from the GC column is directly introduced into the ion source of the 5975C mass spectrometer detector with the following conditions: the mass spectrometer transfer line temperature is held at 250° C.; mass spectrometer source temperature is held at 230° C.; ionization is achieved with 70 eV electron impact; and the quadrupole mass analyzer temperature is held at 150° C. The acquisition range is set to scan from mass to charge ratio (m/z) 33 to 350 at 2 scans per second. The lowest m/z to be scanned must be set above the most abundant air peaks at m/z 28 and m/z 32.

Mass Spectrometer Data Processing. Each headspace flavor component is identified from its retention time and mass spectral fragmentation pattern. As needed, headspace flavor component identifications are confirmed via use of reference standard compounds analyzed under the same conditions defined above and utilized to analyze the samples. This procedure will confirm the retention time and mass spectra match to a standard and correctly identify a given headspace flavor component.

Peaks in the GC-MSD Total Ion Chromatogram (TIC) should be evaluated as to whether they are related to a component of headspace flavor composition or not. Non-headspace flavor components may include 1) siloxane derivatives from SPME fiber; 2) trace level highly volatile hydrocarbons from the toothpaste that are introduced as impurities from ingredients such as surfactant; 3) dentifrice components and carriers such as humectants like glycerin or propylene glycol; 4) GC-MSD system or background peaks that would also be observed during blank injections. Peak purity should be checked via mass spectral integrity across the peak to assure that there are no co-eluting components (including other flavor components). If the peaks are not pure, the situation must be corrected, ideally by optimizing the GC conditions to fully resolve the co-eluting or partially co-eluting components. Peak areas of headspace flavor components should then be obtained from the total ion chromatogram with the following peak area integration parameters: initial threshold 14.5; initial peak width 0.034; shoulder detection OFF; initial area reject 0. When needed, optional manual integration can be utilized, although its use should be minimized, and when used, manual integration must be consistently applied. As above, background, or other non-flavor component peaks should be excluded.

Duplicate GC-MSD injections of samples are performed for each headspace flavor from each dentifrice sample condition and reported peak areas for each flavor component are the average of the duplicate measures. Relative standard deviations of peak areas for each flavor component should generally be less than twenty percent.

Flavor Display Results

Two toothpastes were evaluated using both the Comparative nozzle and the Inventive nozzle: Crest® 3D White™ Brilliance ("Brilliance") and Crest® Pro-Health ("Pro-Health"). For each condition, the weights of the two nurdles analyzed were approximately the same (within +/−(+/−0.1 g) variation of 3.0 grams).

The total flavor release data for each sample under each specific condition shown in TABLE 2 are the sum of the TIC peak areas of headspace flavor components. Unexpectedly, the results in TABLE 2 show that the mean peak area for the overall headspace flavor for each toothpaste increased at all tested times for the Inventive Nozzle. Because the nurdle weights were approximately the same, it is believed these increases were due to the obstructed design of the Inventive Nozzle.

TABLE 2

Flavor Release Measured from Neat Dentifrice at Various Times

| | | Comparative Nozzle | | Inventive Nozzle | | Increase (%) |
|---|---|---|---|---|---|---|
| Samples | Time (s) | Mean Peak Area (n = 2) | RSD (%) | Mean Peak Area (n = 2) | RSD (%) | Inventive vs Comparative |
| Brilliance | 15 | 1.66E+08 | 8.08 | 1.98E+08 | 14.69 | 19.28 |
| | 30 | 2.06E+08 | 4.12 | 3.77E+08 | 1.51 | 83.01 |
| | 60 | 2.58E+08 | 7.74 | 3.75E+08 | 10.62 | 45.35 |
| Pro- | 15 | 7.60E+07 | 20.89 | 1.29E+08 | 1.02 | 69.74 |
| Health | 30 | 1.56E+08 | 0.77 | 1.82E+08 | 6.84 | 16.67 |
| | 60 | 2.01E+08 | 14.40 | 2.95E+08 | 1.27 | 46.77 |

The impact of the Inventive Nozzle on release of individual flavor components from neat Brilliance and neat Pro-Health are shown in TABLE 3 and TABLE 4, respectively. The results in TABLE 3 show that the peak area for each of alpha-pinene, beta-pinene, limonene, eucalyptol, menthone, isomenthone, menthyl acetate, and anethole increased with the Inventive Nozzle at 15, 30, and 60 seconds. For non-polar flavor compounds, such as limonene, alpha- and beta-pinene, the percentage increase was greater compared with polar flavor compounds, such as carvone.

The results in TABLE 4 show that the peak area for each of alpha-pinene, beta-pinene, limonene, eucalyptol, menthone, isomenthone, menthyl acetate, carvone, and anethole increased with the Inventive Nozzle at 15, 30, and 60 seconds. For non-polar flavor compounds, such as limonene, alpha- and beta-pinene, the percentage increase was greater compared with polar flavor compounds, such as carvone. Because the weight of neat Brilliance and neat Pro-Health were approximately the same, it is believed these unexpected increases were due to the obstructed design of the Inventive Nozzle.

TABLE 3

Headspace Individual Flavor Compound Measured from Neat Brilliance at Various Times

| Headspace Flavor Compound | Peak Areas with Comparative Nozzle | Peak Areas with Inventive Nozzle | Increase (%) Inventive vs Comparative |
|---|---|---|---|
| 15 Seconds | | | |
| alpha-Pinene | 9.76E+05 | 2.27E+06 | 132.58 |
| beta-Pinene | 1.06E+06 | 2.23E+06 | 110.95 |
| Limonene | 2.00E+06 | 1.00E+07 | 402.28 |
| Eucalyptol | 1.18E+07 | 1.64E+07 | 39.15 |
| Menthone | 4.92E+07 | 6.39E+07 | 29.95 |
| Isomenthone | 1.91E+07 | 2.22E+07 | 16.00 |
| Menthyl Acetate | 3.40E+06 | 5.02E+06 | 47.73 |
| Menthol | 7.12E+07 | 6.93E+07 | −2.64 |
| Anethole | 7.30E+06 | 9.14E+06 | 25.18 |
| 30 Seconds | | | |
| alpha-Pinene | 1.08E+06 | 5.05E+06 | 368.16 |
| beta-Pinene | 1.16E+06 | 4.96E+06 | 326.29 |
| Limonene | 3.42E+06 | 1.76E+07 | 415.71 |
| Eucalyptol | 1.52E+07 | 3.40E+07 | 124.30 |
| Menthone | 6.30E+07 | 1.25E+08 | 98.74 |
| Isomenthone | 2.45E+07 | 4.43E+07 | 81.23 |
| Menthyl Acetate | 4.47E+06 | 9.65E+06 | 115.89 |
| Menthol | 8.49E+07 | 1.21E+08 | 43.04 |
| Anethole | 8.40E+06 | 1.48E+07 | 76.61 |
| 60 Seconds | | | |
| alpha-Pinene | 9.74E+05 | 3.75E+06 | 285.52 |
| beta-Pinene | 1.05E+06 | 4.21E+06 | 299.32 |
| Limonene | 3.18E+06 | 1.48E+07 | 366.03 |
| Eucalyptol | 1.73E+07 | 3.19E+07 | 84.17 |
| Menthone | 7.16E+07 | 1.24E+08 | 73.49 |
| Isomenthone | 2.95E+07 | 4.34E+07 | 47.22 |
| Menthyl Acetate | 5.08E+06 | 9.42E+06 | 85.46 |
| Menthol | 1.18E+08 | 1.27E+08 | 7.10 |
| Anethole | 1.15E+07 | 1.72E+07 | 49.71 |

TABLE 4

Headspace Individual Flavor Compound Measured from Neat Pro-Health at Various Times

| Headspace Flavor Compound | Peak Areas with Comparative Nozzle | Peak Areas with Inventive Nozzle | Increase (%) Inventive vs Comparative |
|---|---|---|---|
| 15 Seconds | | | |
| alpha-Pinene | 6.43E+05 | 9.96E+05 | 54.86 |
| beta-Pinene | 6.59E+05 | 1.00E+06 | 52.57 |
| Limonene | 1.53E+06 | 2.93E+06 | 91.08 |
| Eucalyptol | 6.13E+06 | 9.60E+06 | 56.56 |
| Menthone | 2.22E+07 | 3.72E+07 | 67.46 |
| Isomenthone | 7.10E+06 | 1.21E+07 | 70.37 |
| Menthyl Acetate | 1.20E+06 | 2.34E+06 | 95.48 |
| Menthol | 2.66E+07 | 4.58E+07 | 72.49 |
| Carvone | 6.44E+06 | 1.12E+07 | 74.58 |
| Anethole | 3.53E+06 | 6.12E+06 | 73.14 |
| 30 Seconds | | | |
| alpha-Pinene | 8.37E+05 | 1.65E+06 | 97.53 |
| beta-Pinene | 9.09E+05 | 1.43E+06 | 57.49 |
| Limonene | 2.18E+06 | 3.49E+06 | 60.16 |
| Eucalyptol | 1.01E+07 | 1.38E+07 | 36.3 |
| Menthone | 3.59E+07 | 4.95E+07 | 38.02 |
| Isomenthone | 1.36E+07 | 1.66E+07 | 21.99 |
| Menthyl Acetate | 2.58E+06 | 3.00E+06 | 15.93 |
| Menthol | 7.09E+07 | 6.89E+07 | −2.73 |
| Carvone | 1.43E+07 | 1.58E+07 | 11 |
| Anethole | 4.96E+06 | 8.11E+06 | 63.54 |
| 60 Seconds | | | |
| alpha-Pinene | 1.39E+06 | 2.39E+06 | 71.71 |
| beta-Pinene | 1.51E+06 | 2.73E+06 | 80.45 |
| Limonene | 4.31E+06 | 1.07E+07 | 148.67 |
| Eucalyptol | 1.47E+07 | 2.32E+07 | 57.9 |
| Menthone | 5.33E+07 | 8.30E+07 | 55.69 |
| Isomenthone | 1.80E+07 | 2.68E+07 | 48.41 |
| Menthyl Acetate | 3.21E+06 | 5.87E+06 | 83.23 |
| Menthol | 7.59E+07 | 9.75E+07 | 28.5 |
| Carvone | 1.88E+07 | 2.62E+07 | 39.26 |
| Anethole | 9.61E+06 | 1.69E+07 | 76.16 |

The increase of total flavor release by use of the Inventive nozzle was also measured from the headspace of dentifrice slurry, a condition more relevant to product usage (TABLE 5). Similar to the results using neat toothpaste, the results in TABLE 5 show an unexpected increase in the mean peak area for the overall headspace flavor at all times tested for the dentifrice slurries.

TABLE 5

Flavor Release Measured from Dentifrice Slurry at 30 Seconds

| | Comparative Nozzle | | Inventive Nozzle | | |
|---|---|---|---|---|---|
| Samples | Mean Peak Area (n = 2) | RSD (%) | Mean Peak Area (n = 2) | RSD (%) | Increase (%) Inventive vs Comparative |
| Brilliance | 9.83E+08 | 6.06 | 1.17E+09 | 2.00 | 18.93 |
| Pro-Health | 4.29E+08 | 16.29 | 5.41E+08 | 13.35 | 26.12 |

The impact of the Inventive Nozzle on individual flavor release from the slurries of Brilliance and Pro-Health was also compared as shown in TABLES 6 and 7, respectively. The results in TABLE 6 show the peak area of each of alpha-pinene, beta-pinene, limonene, eucalyptol, menthone, isomenthone, menthyl acetate, menthol, and anethole measured from the headspace of Brilliance slurry increased with the Inventive Nozzle at 30 seconds. The results in TABLE 7 show that the peak area of each of alpha-pinene, beta-pinene, myrcene, limonene, eucalyptol, p-cymene, menthone, isomenthone, menthol, carvone, and anethole measured from the headspace of the ProHealth slurry increased with the Inventive Nozzle at 30 seconds. Only the peak area for menthyl acetate, which is a flavor component typically with poor display, did not increase.

TABLE 6

Headspace Flavor Measured from Brilliance Slurry at 30 Seconds

| Headspace Flavor Compound | Peak Area with Comparative Nozzle | Peak Area with Inventive Nozzle | Increase (%) Inventive vs Comparative |
|---|---|---|---|
| alpha-Pinene | 1.31E+08 | 1.48E+08 | 13.44 |
| beta-Pinene | 1.21E+08 | 1.38E+08 | 14.45 |
| Myrcene | n.d.* | n.d. | n/a^ |
| Limonene | 2.91E+08 | 3.09E+08 | 6.46 |
| Eucalyptol | 5.26E+07 | 7.17E+07 | 36.32 |
| p-Cymene | n.d. | n.d. | n/a |
| Menthone | 1.81E+08 | 2.48E+08 | 36.89 |
| Isomenthone | 4.68E+07 | 6.65E+07 | 41.96 |
| Menthyl Acetate | 2.41E+07 | 2.46E+07 | 2.06 |
| Menthol | 1.22E+08 | 1.41E+08 | 14.79 |
| Carvone | n.d. | n.d. | n/a |
| Anethole | 1.34E+07 | 2.14E+07 | 60.25 |

*n.d.: not detected
^n/a: not available

TABLE 7

Headspace Flavor Measured from Pro-Health Slurry at 30 Seconds

| Headspace Flavor Compound | Peak Area with Comparative Nozzle | Peak Area with Inventive Nozzle | Increase (%) Inventive vs Comparative |
|---|---|---|---|
| alpha-Pinene | 4.27E+07 | 5.74E+07 | 34.50 |
| beta-Pinene | 4.60E+07 | 6.03E+07 | 31.16 |
| Myrcene | 2.99E+06 | 3.95E+06 | 32.26 |
| Limonene | 1.55E+08 | 1.89E+08 | 21.54 |
| Eucalyptol | 1.60E+07 | 2.07E+07 | 29.46 |
| p-Cymene | 6.04E+06 | 7.07E+06 | 17.02 |
| Menthone | 6.07E+07 | 8.07E+07 | 32.85 |
| Isomenthone | 1.12E+07 | 1.56E+07 | 39.12 |
| Menthyl Acetate | 1.54E+07 | 1.44E+07 | −6.54 |
| Menthol | 4.57E+07 | 5.63E+07 | 23.19 |
| Carvone | 4.22E+06 | 5.51E+06 | 30.66 |
| Anethole | 1.46E+07 | 2.13E+07 | 45.62 |

Additionally, sensory perception when brushing with dentifrice dispensed via the Inventive Nozzle was subjectively observed to be fresher with stronger flavor than with conventional nozzle.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests, or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for dispensing an oral care composition comprising:

dispensing the oral care composition through a nozzle to form a dispensed composition, wherein the nozzle comprises:

an orifice having a central axis and an orifice diameter; and fins partially occluding the orifice, wherein each of the fins has an upper surface and a lower surface, and wherein the fins shear and pressurize the flow of the oral care composition, wherein the dispensed composition has an increased flavor display compared to a control dispensed composition made by dispensing the oral care composition through a control nozzle comprising an unobstructed, circular orifice having the orifice diameter.

2. The method of claim 1, wherein a center of the orifice is occluded.

3. The method of claim 1, wherein the nozzle further comprises a central hub, wherein the fins are coupled to the central hub.

4. The method of claim 1, wherein the fins are not in contact with a central hub.

5. The method of claim 1, wherein the upper surface of each of the fins is distal of the orifice.

6. The method of claim 1, wherein the lower surface of each of the fins is proximal of the orifice.

7. The method of claim 1, wherein the lower surface of each of the fins is distal of the orifice.

8. The method of claim 1, wherein the nozzle further comprises an on-axis extrusion area and an off-axis extrusion area.

9. The method of claim 1, wherein the nozzle further comprises a sidewall defining the orifice, wherein the sidewall comprises an inner wall, a rim, and an outer wall.

10. The method of claim 9, wherein each of the fins further comprise an outer end that extends to the outer wall of the sidewall.

11. The method of claim 9, wherein the lower surface of each of the fins extends from the inner surface of the sidewall.

12. The method of claim 1, wherein the improved flavor display comprises an increase in a sum of mean peak area of headspace flavor components measured from the dispensed composition.

13. The method of claim 12, wherein the improved flavor display is measured at 15 seconds, 30 seconds, or 60 seconds after enclosing the dispensed composition.

14. The method of claim 12, wherein the increase in the sum of mean peak area of headspace flavor components is in a range of 10% to 90%.

15. The method of claim 1, wherein the improved flavor display comprises an increase in a sum of mean peak area of headspace flavor components measured from the dispensed composition in a slurry.

16. The method of claim 15, wherein the improved flavor display is measured at 15 seconds after forming the slurry.

17. The method of claim 15, wherein the increase in the sum of mean peak area of headspace flavor components is in a range of 5% to 40%.

18. The method of claim 1, wherein the improved flavor display comprises an increase in a mean peak area of limonene.

19. The method of claim 1, wherein the improved flavor display comprises an increase in a mean peak area of alpha-pinene.

* * * * *